US009308464B1

(12) United States Patent
Torres

(10) Patent No.: US 9,308,464 B1
(45) Date of Patent: Apr. 12, 2016

(54) SET OF BUILDING COMPONENTS

(71) Applicant: Mattel, Inc., El Segundo, CA (US)

(72) Inventor: Ronald Torres, Hacienda Heights, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/280,106

(22) Filed: May 16, 2014

Related U.S. Application Data

(60) Provisional application No. 61/942,349, filed on Feb. 20, 2014.

(51) Int. Cl.
*A63H 33/08* (2006.01)
*A63H 33/04* (2006.01)

(52) U.S. Cl.
CPC ..... *A63H 33/044* (2013.01)

(58) Field of Classification Search
USPC ..... 446/85, 102, 105, 108, 111, 122, 124, 446/126, 128
See application file for complete search history.

(56) References Cited

U.S. PATENT DOCUMENTS

| | | | | |
|---|---|---|---|---|
| 251,763 | A | | 1/1882 | Carpenter |
| 1,000,395 | A | | 8/1911 | Frost |
| 1,205,101 | A | | 11/1916 | Meyer |
| 1,281,856 | A | | 10/1918 | Shaw |
| 1,434,861 | A | | 11/1922 | Vancl |
| 1,437,867 | A | | 12/1922 | Sixta |
| 1,866,176 | A | | 7/1932 | Schmidt |
| 1,883,214 | A | | 10/1932 | Wilson et al. |
| 1,898,297 | A | | 2/1933 | Fox |
| 1,935,256 | A | | 11/1933 | Wessel |
| 1,985,032 | A | | 12/1934 | Hoult |
| 2,116,301 | A | | 5/1938 | Champlin |
| 2,147,237 | A | | 2/1939 | Bluthardt |
| 2,247,614 | A | | 7/1941 | Lingenfelter |
| 2,249,060 | A | | 7/1941 | Stone |
| 2,497,657 | A | | 2/1950 | Cole |
| 2,926,941 | A | | 3/1960 | Thompson |
| 2,970,388 | A | | 2/1961 | Yonkers |
| 3,002,315 | A | | 10/1961 | Kuhn |
| 3,168,793 | A | | 2/1965 | Gibson |
| 3,199,246 | A | | 8/1965 | Fischer |
| 3,242,610 | A | | 3/1966 | Christiansen |
| 3,386,590 | A | * | 6/1968 | Gretz ..... 211/189 |
| 3,419,970 | A | | 1/1969 | Wanderman |
| 3,890,738 | A | | 6/1975 | Bassani |
| 3,902,291 | A | | 9/1975 | Zucht |
| 3,924,348 | A | | 12/1975 | Taylor et al. |

(Continued)

*Primary Examiner* — Kurt Fernstrom
(74) *Attorney, Agent, or Firm* — Edell, Shapiro & Finnan, LLC

(57) ABSTRACT

A set of building components includes at least connector components and elongate members. A connector component includes a main body and one or more receptacles. In some embodiments, a connector component may also include male studs and/or female receiving areas configured to couple the connector to other components or conventional building blocks which include the corresponding feature. The elongate members can be secured within the receptacles of the connectors and, in some embodiments, may include slots along a lateral surface to facilitate this connection and provide an additional coupling for further building components. Moreover, in some embodiments, a set of building components may also include sliders configured to be movably coupled around the elongate members. The sliders may also include male studs and/or female receiving areas in some embodiments.

18 Claims, 8 Drawing Sheets

(56) References Cited

U.S. PATENT DOCUMENTS

| | | | | | |
|---|---|---|---|---|---|
| 4,058,909 | A | | 11/1977 | Poleri | |
| 4,078,328 | A | | 3/1978 | Rayment | |
| 4,461,480 | A | | 7/1984 | Mitchell | |
| 4,740,188 | A | | 4/1988 | Coster | |
| 4,911,672 | A | * | 3/1990 | Erickson | 446/112 |
| D308,705 | S | | 6/1990 | Olsen | |
| D309,332 | S | | 7/1990 | Olsen | |
| D325,056 | S | | 3/1992 | Pagel | |
| D325,942 | S | | 5/1992 | Hoyer | |
| D326,874 | S | | 6/1992 | Dideriksen et al. | |
| D327,518 | S | | 6/1992 | Pagel | |
| D332,640 | S | | 1/1993 | Pagel | |
| D332,809 | S | | 1/1993 | Knudsen | |
| 5,180,323 | A | | 1/1993 | Justice | |
| D333,851 | S | | 3/1993 | Olsen | |
| D344,301 | S | | 2/1994 | Berggreen | |
| D345,398 | S | | 3/1994 | Plagborg | |
| D348,698 | S | | 7/1994 | Berggreen | |
| D359,523 | S | * | 6/1995 | Yeung | D21/501 |
| 5,451,177 | A | * | 9/1995 | Gilman | 446/128 |
| D394,473 | S | | 5/1998 | Michaelsen | |
| 5,761,852 | A | | 6/1998 | Liu | |
| 5,788,555 | A | * | 8/1998 | Glynn | 446/124 |
| 5,803,782 | A | * | 9/1998 | Selton | 446/126 |
| 5,984,756 | A | | 11/1999 | Krog | |
| 6,030,270 | A | * | 2/2000 | Krog | 446/102 |
| 6,273,778 | B1 | * | 8/2001 | Kyster | 446/168 |
| 6,461,215 | B1 | | 10/2002 | Kunz et al. | |
| 6,464,553 | B2 | | 10/2002 | Huang | |
| 6,502,708 | B2 | * | 1/2003 | Daniel | 211/189 |
| 6,554,677 | B2 | | 4/2003 | Leemon | |
| 6,554,678 | B2 | | 4/2003 | Lavender | |
| 6,558,222 | B1 | | 5/2003 | Maddock | |
| 6,565,406 | B2 | | 5/2003 | Huang | |
| 6,626,727 | B2 | | 9/2003 | Balanchi | |
| 6,648,715 | B2 | * | 11/2003 | Wiens et al. | 446/121 |
| 6,669,526 | B2 | | 12/2003 | Manville et al. | |
| 6,682,385 | B2 | * | 1/2004 | Atzen et al. | 446/124 |
| 6,874,291 | B1 | | 4/2005 | Weber | |
| 6,966,813 | B2 | | 11/2005 | Donahue | |
| 7,044,825 | B2 | | 5/2006 | Glickman et al. | |
| 7,198,537 | B1 | | 4/2007 | Clever et al. | |
| 7,371,146 | B2 | | 5/2008 | Scarborough | |
| 7,371,147 | B2 | | 5/2008 | Tusacciu | |
| 7,374,468 | B2 | | 5/2008 | Flodin et al. | |
| 7,625,261 | B2 | | 12/2009 | Andersen | |
| 7,985,115 | B2 | | 7/2011 | McCloskey | |
| 8,070,551 | B1 | * | 12/2011 | Clever | 446/124 |
| D683,409 | S | | 5/2013 | Lomax et al. | |
| 8,801,491 | B2 | * | 8/2014 | Bruder | 446/124 |
| 2002/0098774 | A1 | | 7/2002 | Huang | |
| 2004/0077258 | A1 | | 4/2004 | Vicentelli | |
| 2005/0245167 | A1 | | 11/2005 | Sinisi | |
| 2008/0090485 | A1 | | 4/2008 | Glickman et al. | |

* cited by examiner 460A
600
90A
460
90A
650

650
250
430
450
600
360
600
810
410
600
120
800
925
800
520
810
460B
520
910

SET OF BUILDING COMPONENTS

CROSS-REFERENCE TO RELATED APPLICATION

This application claims priority to and the benefit of U.S. Provisional Patent Application No. 61/942,349, filed Feb. 20, 2014, entitled "Set of Building Components," the entire disclosure of which is incorporated herein by reference in its entirety.

FIELD OF THE INVENTION

The present invention relates to a set of building components. More specifically, the present invention relates to a set of building components that includes connectors with coupling portions configured to receive elongate or elongated members, such that the set of building components facilitates the construction of large assemblies with minimal components.

BACKGROUND OF THE INVENTION

Sets of building blocks, and in particular sets of building blocks with coupling portions, are well known and widely popular among children. Some conventional sets of building blocks include blocks that have a body that includes an upper portion and several side walls that extend downwardly from the upper portion. The downwardly extending walls define a cavity or aperture therebetween. Typically, one or more studs or posts extend from the upper surface of the block. The cavity or aperture defined by these walls is sized to receive the studs of another block so that a user may stack or build multiple blocks on top of each other. Generally, the studs of a first block are inserted into an aperture or cavity of a second block in order to stack, build or otherwise couple the first and second blocks together.

Conventional blocks that are coupled to each other are retained in a coupled arrangement by the friction between the outer surfaces of the stud or studs of one block and the walls and other surfaces of another block with which the studs are in contact. The outer side surface or surfaces of a stud are perpendicular to the upper portion of the block from which they extend. Similarly, the walls or surfaces of a block that are engaged by a stud are perpendicular to the upper portion of that block. Thus, when blocks are coupled together, the blocks must be at least partially vertically aligned or overlapped. Due to this, a set of conventional blocks intended to provide an assembly with a large footprint must include an extremely large number of conventional blocks which, in turn, renders large assemblies expensive and time-consuming to create.

In contrast with conventional building blocks, some conventional building sets have been introduced which include connectors and rods. While these sets may allow for large creations to be made relatively quickly, it is sometimes difficult to include the same amount of detail or decoration with these conventional building sets, particularly in comparison to traditional building blocks. Additionally, these sets are typically not combinable or usable with conventional building blocks that include studs and cavities, as described above. Thus, there is a need for a new design for a set of building components that can reduce the amount of building components required to build a large structure or creation and can be used in connection with conventional building blocks.

SUMMARY

According to at least one embodiment of the present invention, a set of building components includes a first connector including at least one receptacle, a second connector including at least one receptacle, and an elongate member including a first end and a second end. The first end of the elongate member is configured to be secured in a receptacle of the first connector and the second end of the elongate member is configured to be secured in a receptacle of the second connector.

BRIEF DESCRIPTION OF THE DRAWINGS

Like reference numerals have been used to identify like elements throughout this disclosure.

DETAILED DESCRIPTION OF THE INVENTION

Generally referring to the figures, at least one exemplary set of building components in accordance with the present invention is shown. A set of building components includes two main types of building components: connectors and elongate members, each of which may include various features and configurations, as will be described in detail below. The connectors of the present invention each include one or more receptacles configured to receive the elongate members of the present invention. Additionally, some implementations of the connector components may also include one or more projecting portions or studs and/or one or more receiver or receiving areas that are configured to receive a stud included on another building component.

It is to be understood that the term "building component" is used herein to refer to any article or item included in the set of the present invention which may be used to construct an assembly. The quantity of receptacles, receiving areas, and studs included on a building component can vary—depending on the shape, size, and configuration of the building component—from component to component and in particular, from connector component to connector component. In fact, some embodiments may include no studs and/or receiving areas. In the embodiments which include studs and/or receiving areas, the studs and/or receiving areas may be arranged in one or more rows on any desirable surface of the building component, depending on the width of the surface of that building component. For example, the studs may be arranged in a 1 by 6 grid. Alternatively, the studs may be arranged in a 2 by 3 grid or a 6 by 6 grid, depending on the shape and size of the building component. In embodiments which include studs and receiving areas, the arrangement and quantity and arrangement of receiving areas preferably mirrors or matches the arrangement of studs on that particular building component.

Additionally, the term "building component" is not limited to articles or items which are block-shaped. For example, while one embodiment of a building component according to the present invention is a rectangular parallelepiped, other embodiments of the building component may be flat and/or arcuate. Also, in some embodiments, a building component may have a configuration that is not a standard geometric shape. For example, a building component may be a portion of a building (such as a toy window, door, door frame, etc.) or a toy vehicle (an axle supporting structure, car window, a hood, a trunk, etc.) or other product.

Figure 1A:
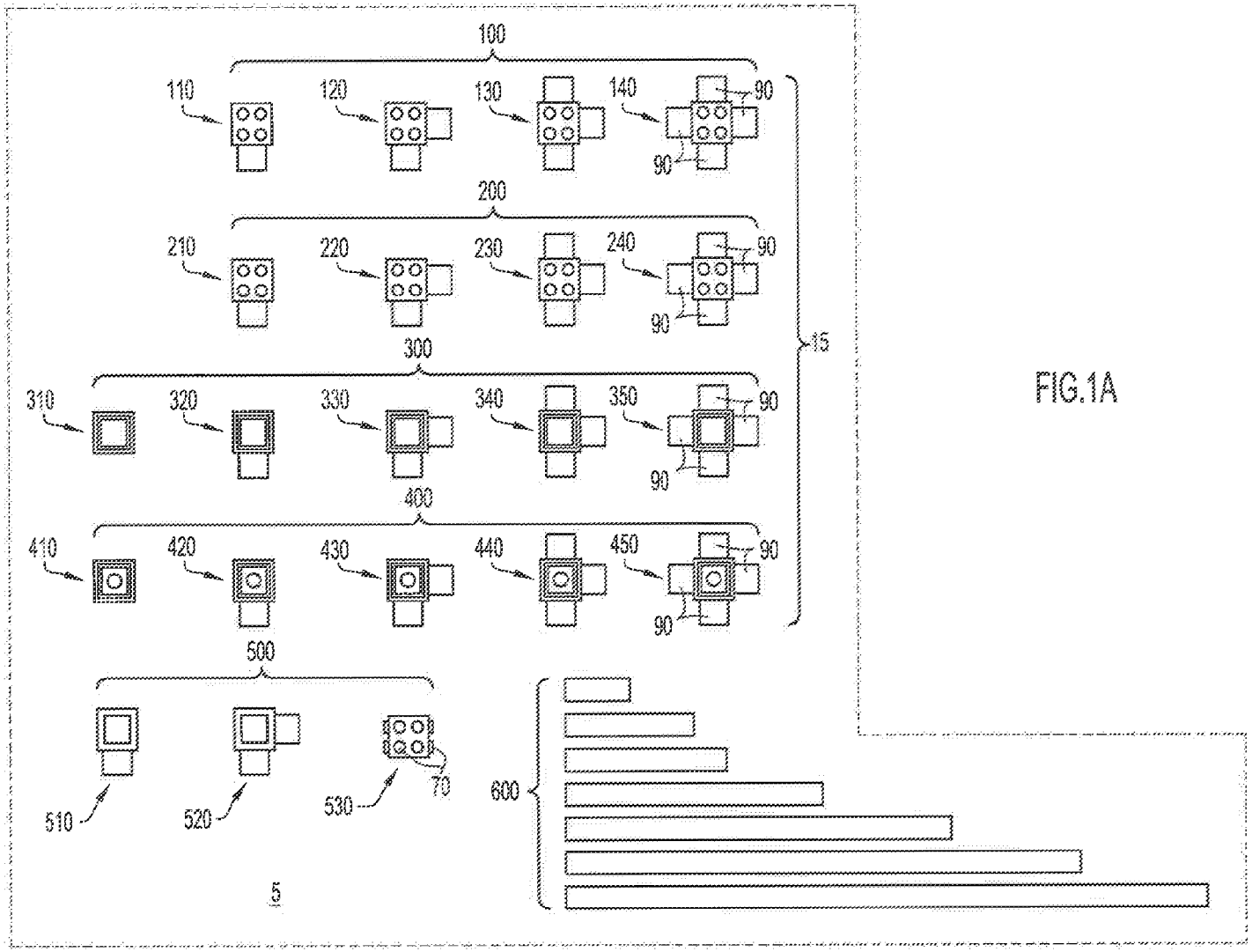
FIG. 1A shows a top view of an exemplary embodiment of a set of building components in accordance with the present invention including five different families of connector components.
Figure 1B:
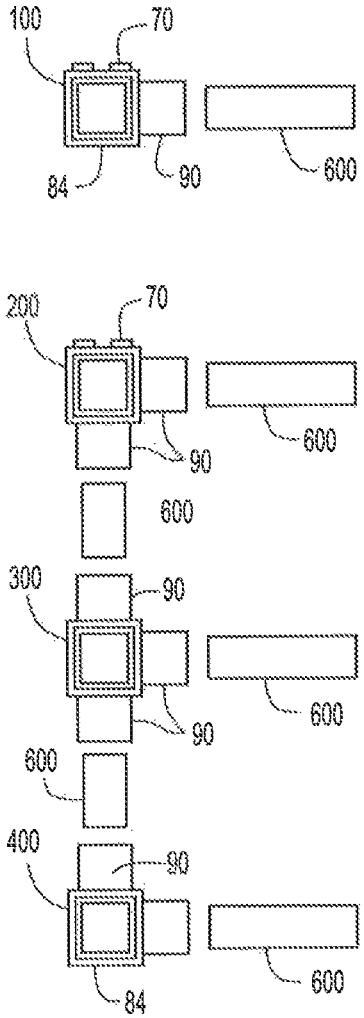
FIG. 1B shows a side view of an exemplary embodiment of each family shown in FIGS. 1A-B.

FIGS. 1A-B show one exemplary set of building components 5 including four families—families 100, 200, 300 and 400—of connectors 15, a family of sliders 500, and a family of elongate members 600. However, although the set of building components shown in FIGS. 1A-B includes specific building components, it is to be understood that the shown components are not intended to be limiting and are merely exemplary embodiments of some various components that may be included in a set of building of components of the present invention.

As shown in the top view provided by FIG. 1A, the connector components included in each family 100, 200, 300, 400 may include any desirable amount of receptacles 90. However, each connector component included in a particular family also includes at least one common or uniting feature. In this particular embodiment, and as shown by the connector components representative of the four connector families 100, 200, 300, 400 included in the side view of FIG. 1B, each connector component included in a particular family 100, 200, 300, 400 includes the same top and bottom surface. In other words, in this particular embodiment, the families 100, 200, 300, 400 of connector components merely represent a collection of connector components with the same top and bottom features or surfaces.

Accordingly, and as shown best in FIG. 1A, each family 100, 200, 300, 400 may include connector components 15 with any desirable number of receptacles 90, provided that the connector component 15 includes particular features at or on its top and bottom surfaces. However, it is to be understood that in other embodiments, a set of building components may include any desirable connectors, sliders, and elongate members that may or may not share common features with other similar pieces or parts. Moreover, in other embodiments, any building components included in a set may be of any desirable shape and size and may be formed with any number of receptacles, receiving areas or studs included thereon or therein. As an example, another embodiment may include families of connectors which have the same configurations as the connectors included in families 100, 200, 300 and 400, but the main body of each connector may be one square unit larger, such that those connectors which include studs include a three by three grid as compared to the two by two grid included on families 100 and 200 of the present embodiment. In other embodiments, the receptacles 90 included in the connectors may either be angled or receive the elongate members by extending into the elongate members, as opposed to extending around the elongate members.

Still referring to FIGS. 1A-B, in this particular set of building components 5, family 100 includes connectors with studs 70 on their top surfaces and receiving areas 84 on their bottom surfaces. By comparison, family 200 also includes connector components with studs 70 on their top surfaces, but each connector component includes a receptacle 90 extending from its bottom surface (as compared to receiving areas). Despite this difference, any connector included in family 100 or 200 may also include a receptacle 90 on any of its side walls. Specifically, and as shown in FIG. 1A, families 100 and 200 may each include connectors with a single receptacle 90 (connectors 110, 210), connectors with two receptacles 90 (connectors 120, 220), connectors with three receptacles 90 (connectors 130, 230), and connectors with four receptacles 90 (connectors 140, 240).

In contrast with families 100 and 200, families 300 and 400 include connectors that do not include any studs 70. Instead, and as shown in FIG. 1B, the connectors included in family 300 include a receptacles 90 extending from both their top and bottom surfaces while the connectors included in family 400 include a receptacle 90 extending from their top surfaces and receiving areas 84 formed in their bottom surfaces. Any connector included in families 300 and 400 may also include anywhere from zero to four receptacles 90 on its respective side walls. In particular, connector components 310 and 410 include zero receptacles 90 on their side walls, connector components 320, 420 include a single receptacle 90, connector components 330, 430 include two receptacles 90, connector components 340, 440 include three receptacles 90, and connector components 350, 450 include four receptacles 90. However, it is to be to be understood that while the receptacles 90 are shown in certain configurations in FIG. 1A, it is to be understood that any connectors including any number of receptacles 90 in any desirable configuration may be considered a part of family 300 or 400, as well as family 100 or 200, provided that the connector 15 has the top and bottom surfaces as described herein. For example, a connector with angled receptacles may be considered part of family 100, 200, 300, or 400 if it includes the requisite top and bottom surfaces.

Now referring specifically to FIG. 1A, in this particular embodiment, slider family 500 includes three building components—510, 520, and 530—that include receptacles that extend through the main body of the components and may alternately be referred to as through receptacles. In other words, building components 510, 520 and 530 are sliders, at least in part because the through receptacles may allow these components to slide or move along the length of an elongate member 600 in either direction. In this particular embodiment, building components 510 and 520 include a through receptacle which extends from the top surface of the main body to the bottom surface and, thus, may be classified as "vertical sliders," while component 530 includes a through receptacle which extends through two opposing side walls of component 530 and, thus, may be classified as a "horizontal slider." However, regardless of the classifications of these sliders, it is to be understood that any slider may be used to slide in any desirable direction provided the slider is properly oriented around an elongate member.

In addition to a through receptacle extending through the main body, each of the sliders 500 may also include additional features on the surfaces surrounding the through receptacle. Due to the inclusion of a through receptacle, any such additional features will be oriented perpendicular to the through receptacle. For example, in this particular embodiment, slider 510 includes a receptacle 90 extending from a sidewall while slider 520 includes two receptacles 90 extending from two of its side walls and each of the receptacles 90 included on sliders 510 and 520 extends perpendicularly away from the through receptacle. By comparison, building component 530 includes studs 70 on the surfaces which surround the horizontal through receptacle—its top surface, bottom surface, and two opposing side walls that do not contain the through receptacle—and each of the studs extends perpendicularly away from the through receptacle.

Still referring to FIG. 1A, the set of building components 5 also includes elongate members 600 of varying lengths. In FIG. 1A, each elongate member 600 has the same substantially-square cross section, but the lengths of each elongate member are multiples of a standard unit. For example, in one exemplary embodiment, each elongate member has a cross section that measures approximately 0.35 inches by approximately 0.35 inches and the length of each elongate member 600 is a multiple of a standard unit of approximately 0.63 inches. Thus, from shortest to longest, the elongate tubes may measure approximately 1.26 inches (approximately x2 standard units), approximately 2.52 inches (approximately x4), approximately 3.15 inches (approximately x5), approximately 5.04 inches (approximately x8), approximately 7.56 inches (approximately x12), approximately 10.08 inches (approximately x16), and approximately 12.6 inches (approximately x20). In other embodiments, the elongate members may be any desirable multiple of any desirable standard unit.

Additionally, it is to be understood that the elongate members 600 may be manufactured from any desirable material. Accordingly, in some embodiments, the elongate members 600 may be sufficiently stiff, but in other embodiments, the elongate members 600 may be flexible to provide curved connections between building components (see elongate member 650 of FIGS. 8-9). Similarly, it is to be understood that the elongate members 600 may be any desirable extruded shape. For example, in some embodiments, and as detailed below, the elongate members 600 may be substantially U- or C-shaped (i.e. a square extrusion with a slit or slot along one of the lateral faces) such that the elongate member 600 may at least have some flexibility to ease friction when being secured in a connector and be able to movably receive plates or other flat building components therein.

Figure 2:
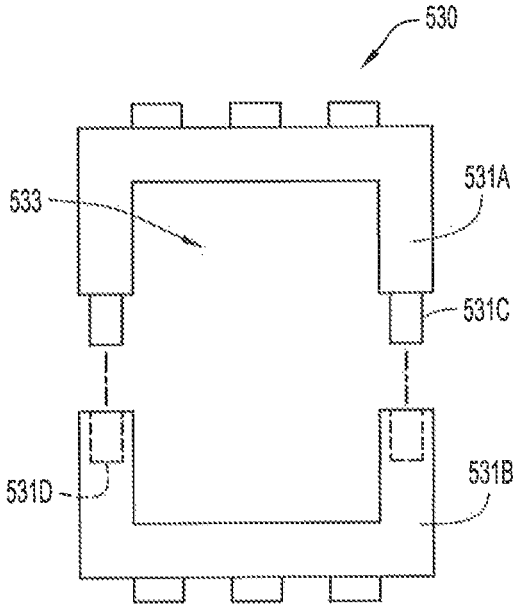
FIG. 2 shows an exploded side view of a building component in accordance with the present invention.

Referring to FIG. 2, an embodiment of building component 530 is illustrated. In this embodiment, building component 530 includes two portions 531A and 531B that are coupleable together to define a through passageway 533. The portions 531A and 531B are placeable on opposite sides of an elongate member and can be coupled together via posts 531C and receptacles 531D.

Figure 3:
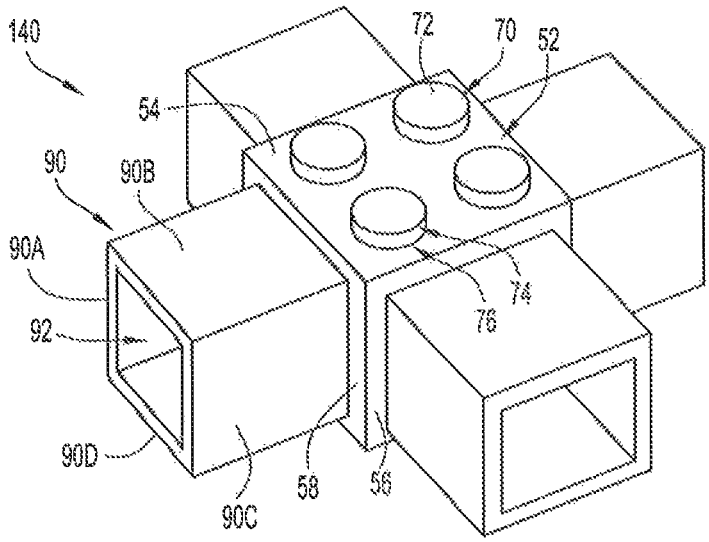
FIG. 3 shows a top perspective view of an exemplary embodiment of a building component of the set of building components of FIGS. 1A-B, in accordance with the present invention.
Figure 4:
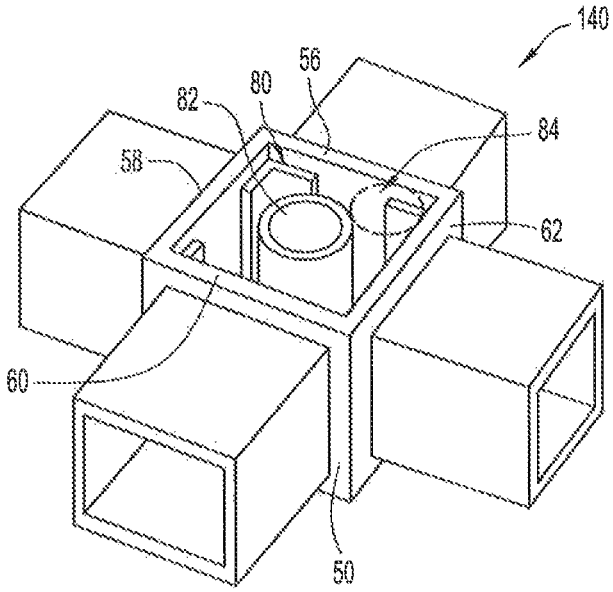
FIG. 4 shows a bottom perspective view of the building component of FIG. 3.

Now turning to FIGS. 3 and 4, an embodiment of a toy building component according to the present invention is illustrated. In particular, connector 140 from FIG. 1A is shown. In this particular embodiment, the connector 140 includes a main body 52 with a top or an upper surface 54 and several side walls 56, 58, 60, and 62 extending downwardly from the main body 52. At least one projecting portion or stud 70 extends upwardly from the upper surface 14 of the main body 52. Referring to FIG. 3, the stud 70 includes an outer surface 72 defining the periphery of the stud 70. In some embodiments (not shown), the stud 70 may also include an inner surface that defines a receptacle or void, in order to increase the flexibility, and thus, the tolerance of the stud 70. In this particular embodiment, four studs 70 are each formed by a continuous, straight wall and each stud 70 has an upper or top end 74 and a lower or bottom end 76, but it is to be understood that in other embodiments any number of studs 70 may be included and the studs 70 may be undercut or angled as desired.

Referring to FIG. 4, a bottom perspective view of connector 140 is shown. As shown, a building component 50 may also include at least one interior wall 82 extending downwardly from the top portion 54 of main body 52. Together, side walls 56, 58, 60, and 62 collectively define a cavity 80 and the at least one interior wall 82 may extend through a central portion of cavity 80. Collectively, the at least one interior wall 82 and side walls 56, 58, 60, 62 form receiving areas 84 in cavity 80, into which a stud from another building component may be inserted. In FIG. 4, one such receiving area 84 is shown in hashed lines with the understanding that this receiving area 84 is representative of multiple receiving areas included in cavity 80. Generally, the studs 70 of a first building component may be inserted into the cavity 80 and secured between some combination of internal walls 82 and side walls 56, 58, 60, and 62. In this particular embodiment, each stud 70 is secured in a corner of the cavity 80, between two of side walls 56, 58, 60, and 62 and the internal wall 82, but in other embodiments (i.e. larger building components), studs 70 may be secured between as many as four internal walls and as few as zero side walls.

Figure 5B:
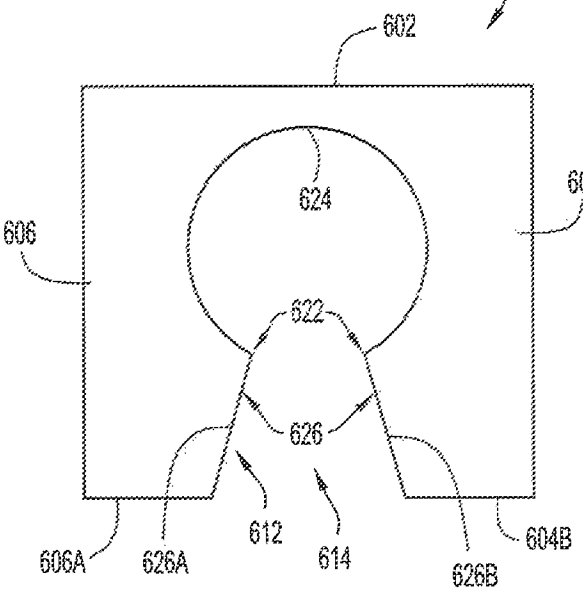
FIG. 5B shows a sectional view taken along Line 5-5 of FIG. 5A.
Figure 5A:
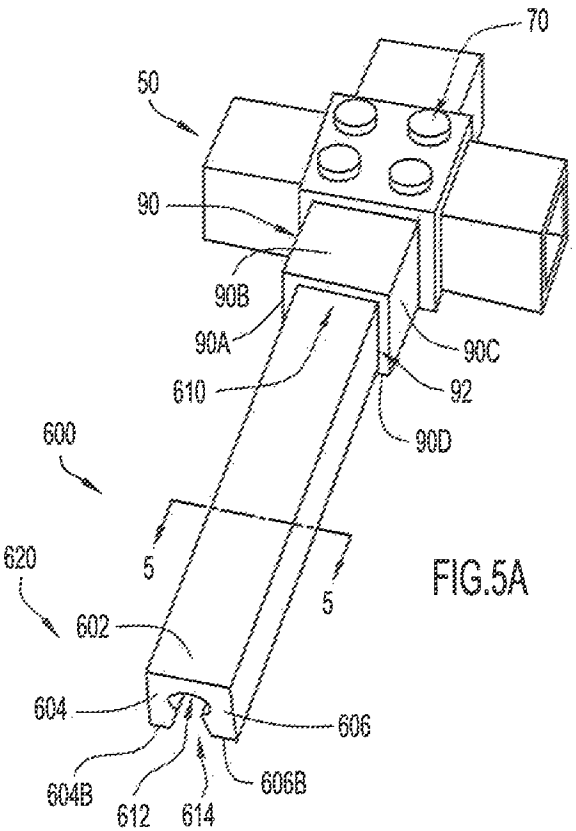
FIG. 5A shows a perspective view of the building component of FIG. 3 with an additional building component attached thereto.

Still referring to FIGS. 3-4, but now with reference to FIG. 5A as well, building component 50 also includes four receptacles 90. In this particular embodiment, each receptacle 90 is formed from four receptacle walls 90A, 90B, 90C, and 90D which extend perpendicularly from side walls 56, 58, 60, and 62 in order to form a receptacle cavity 92. However, in other embodiments, walls 90A, 90B, 90C, 90D may extend in any direction from side walls 56, 58, 60, 62 or include a bend to first extend perpendicularly and then angle away from the side walls 56, 58, 60, 62. In this particular embodiment, the building component 90 includes a receptacle 90 on each one of its side walls 56, 58, 60, and 62, but as will be described in more detail below, a receptacle 90 may be included on or coupled to any surface of building component 50 in different implementations. In fact, in some implementations, the main body 52 may be configured as a slider and include a through receptacle, as described in more detail below. As mentioned, the receptacle cavity 92 is configured to receive an end of an elongate member 600, such that multiple building components 50 may be coupled together at varied distances. Thus, instead of stacking building components atop or beside each other in order to span a distance, a user may simply use a collection of building components and elongate members.

As shown in FIG. 5A, an elongate member 600 extends from a first end 610 to a second end 620 and is generally configured so that the first and second ends 610, 620 may be frictionally received within receptacles 90 included on connector components. In this particular embodiment, the elongate member 600 includes a top 602, a first side 604 and a second side 606 which give the elongate member 600 a substantially square cross-section. Additionally, in this particular embodiment, the first and second sides 604, 606 extend downwards from top 602 to ends 604B and 606B, respectively, and an interior wall 612 extends arcuately upwardly (arcuately towards top 602) therebetween, such that the elongate member is substantially C-shaped around a slot 614. However, in other embodiments, an elongate member 600 may be substantially solid, annular, etc., if desired.

In some embodiments, when an elongate member 600 is inserted into cavity 92 of a receptacle 90, each of the top 602 and walls 604, 606 engage at least one of the receptacle walls 90A, 90B, 90C, and 90D in order to frictionally secure the elongate member 600 within the receptacle 90. In this particular embodiment, the C-shape of the elongate member 600 facilitates this engagement by providing an elongate member 600 that may be able to flex or bend inwards into slot 614 and away from the receptacle walls 90A, 90B, 90C, and 90D to decrease the frictional resistance between the elongate member 600 and the receptacle walls 90A, 90B, 90C, and 90D when the elongate member 600 is inserted therein. Furthermore, in some embodiments, a C-shaped elongate member 600 may be secured to a connector by inserting a portion of the connector into the slot 614 in lieu of or in addition to the engagement provided by receptacle 90. For at least these reasons, a substantially C-shaped elongate member 600 may be preferred. However, despite this preference, it is to be understood that the elongate member 600 need not include a slot 614 in order to be frictionally secured within a receptacle 90.

Still referring to FIG. 5A, but now with reference to FIG. 5B as well, since this particular embodiment of elongate member 600 is substantially square, the rotational alignment of the elongate member 600 within a receptacle 90 (i.e. which receptacle wall 90A, 90B, 90C, and 90D the top 602 is aligned with) may not impact whether the elongate member 600 may be secured within a receptacle 90. However, in other embodiments, the cross section of elongate member 600 and receptacles 90 may be shaped as desired (i.e. triangular, hexagonal, irregular polygon, etc.) and, thus, in some embodiments, a specific rotational alignment may be required to secure the elongate member 600 within a receptacle 90.

Moreover, in some implementations, slot 614 of the U-shaped elongate member 600 may be shaped or otherwise configured to receive additional building materials, as is described in detail below, such that slot 614 provides an additional benefit and play feature. Thus, while the rotational alignment of the elongate member 600 within a receptacle may not impact whether the elongate member 600 may be secured within a receptacle 90 in all embodiments, the rotational alignment may still be important for the orientation of slot 614. Thus, to maximize the possible rotational alignments that a slot 614 may be disposed in, the cross sections of the elongate member 600 and the receptacle 90 are preferably the same, equilateral shape.

Now referring specifically to FIG. 5B, the slot 614 is formed from an interior wall 612 and configured to securely receive building components, such as flat plates. As shown, the interior wall 612 includes a first section 626 and a second section 624 which are separated by a transition point 622. In this particular embodiment, the first section 626 includes a first wall 626A which extends upwardly and inwardly from edge 606A and a second wall 626B which extending upwardly and inwardly from edge 604B. Each of walls 626A, 626B is substantially flat such that walls 626A, 626B may act to guide building components towards transition point 622. Above the transition point 622, walls 626A, 626B are coupled together by the second section 624 which, in this embodiment, is an arcuate wall. In other words, the slot 614 may be substantially keyhole-shaped. Due this configuration, the elongate member 600 may receive building components within slot 614 with the interior wall 612 only engaging the building component at the transition point 622 and portions of the second wall section 624. Thus, any building components received in slot 614 will be slidably secured therein, providing features similar to sliding doors and the like.

Figure 6:
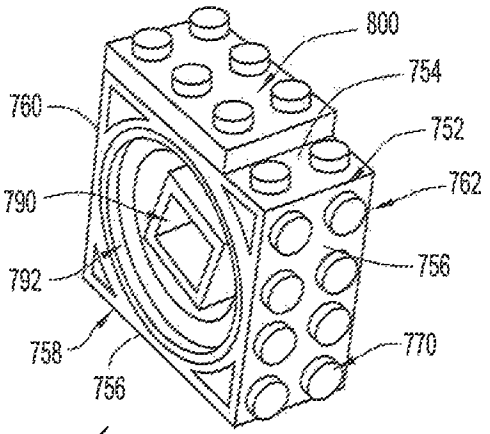
FIG. 6 shows a top perspective view of another exemplary embodiment of a building component from another exemplary set of building components, in accordance with the present invention.

Now turning to FIG. 6, one exemplary slider component 700 is shown. As can be seen, in this particular embodiment, slider 700 includes a main body 752 with a top portion 754 and a bottom portion 756. Additionally, slider includes opposing side walls 756 and 760 that extend between top portion 754 and bottom portion 756 of main body 752. Each of the top 754, sides 756, 760, and bottom 756 includes a grid of studs 770 arranged in a two by four grid and configured to be received within the receiving areas of another building component, such as the building block 800 shown coupled to the studs 770 included on top 754.

Within the top 754, sides 756, 760, and bottom 756, the slider 700 includes a through receptacle 790 that extends from a first side 758 to a second side 762. Consequently, an elongate member 600 can be inserted through the receptacle 790, and as the name implies, the slider 700 may slide thereon. Moreover, in this particular embodiment, the through receptacle is movably coupled to the main body 752 via a rotatable support 792. Thus, the main body 752 may rotate around the through receptacle 790, or vice versa, to provide a new and interesting play feature that can both move on an elongate member 600 and move around an elongate member 600. Notably, slider 700 was not shown included in the set 5. Nevertheless, it is to be understood that each of the sliders 500 included in set 5 may be modified or altered to include a support similar to support 792 such that the main body of each of the sliders 500 may rotate with respect to its through receptacle and vice versa.

Now turning to FIGS. 7-10, exemplary structures built or being built with the building components described above are shown. Each of the figures shows different views of various stages of construction of various creations or structures to illustrate how the building components of the present invention can be used. Additionally, the structures of FIGS. 7-10 also include conventional building blocks in order to illustrate how the building components of the present invention may be used in conjunction with conventional building blocks.

Figure 7:
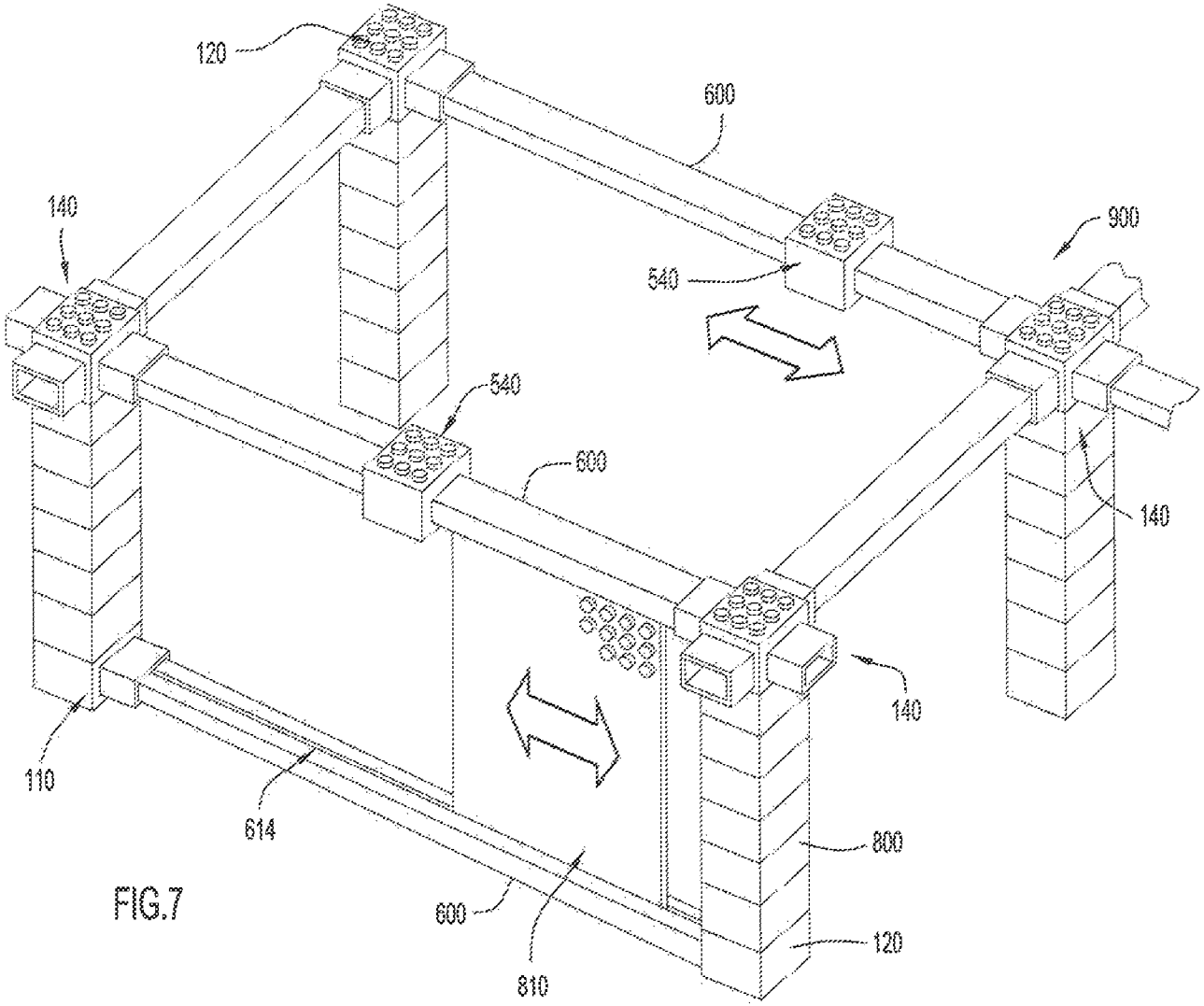
FIGS. 7-9 show perspective views of assemblies constructed from an exemplary set of building components, in accordance with the present invention.

First, FIG. 7 is a sketch of one exemplary structure constructed with building components of the present invention. As shown, structure 900 is a substantially shaped as a rectangular parallelepiped, with elongate members 600 extending between four stacks of building components. Each stack of building components includes a connector (i.e. connectors 110 or 120) at its base, a connector 140 or 120 at its top and approximately six conventional building blocks 800 stacked therebetween. The blocks included in these stacks (blocks 800 and connectors 110, 120, or 140) are coupled together via studs and receivers included on each of the blocks, in the manner detailed above. Then, in order to connect the stacks of building components at distances spaced apart from each other, C-shaped elongate members 600 are inserted into opposite receivers included in the connectors 120, 140. Additionally, structure 900 also includes sliders 540, on the elongate members 600 that are connecting the connectors 140. Similar to sliders 530, each slider 540 includes studs 70 on its outer surfaces, but only its top and bottom surfaces and not its side walls.

Notably, as shown in FIG. 7, by utilizing the building components of the present invention, the structure spans a horizontal distance that is nearly twice as long as the vertical distance covered spanned by the structure and only three pieces (two connectors and an elongate member) are used to span this distance as opposed to the eight pieces required for the shorter vertical distance covered by the stack of building components. Furthermore, the slots 614 of at least two of the elongate members 600 are oriented to face each other in structure 900, such that a plate 810 can ride therein, as discussed above, thereby providing a new and unique play feature. The sliders 540 may be used to secure the plates 810 in different locations along the elongate members if desired.

Figure 8:
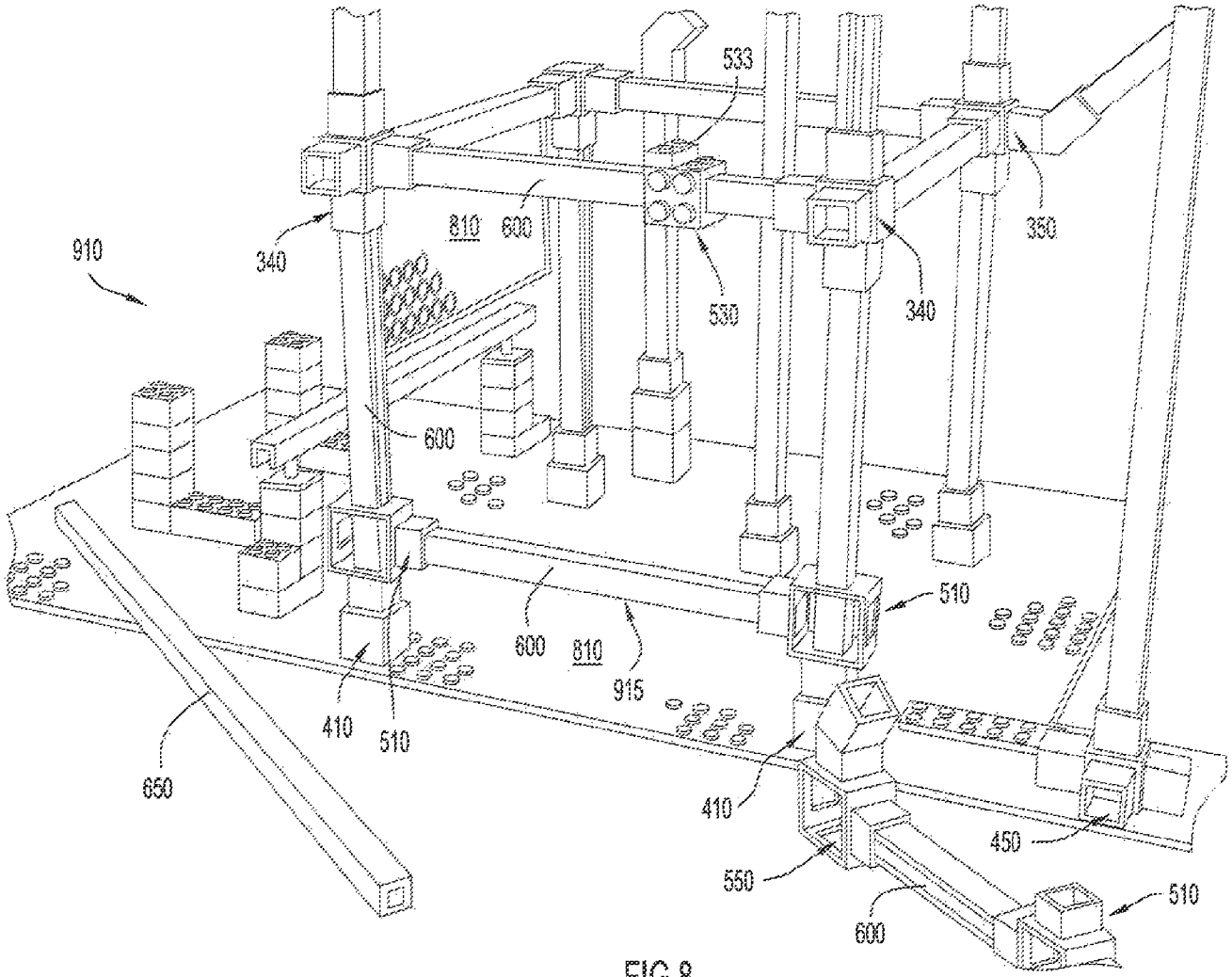
Figures 9, 9A:
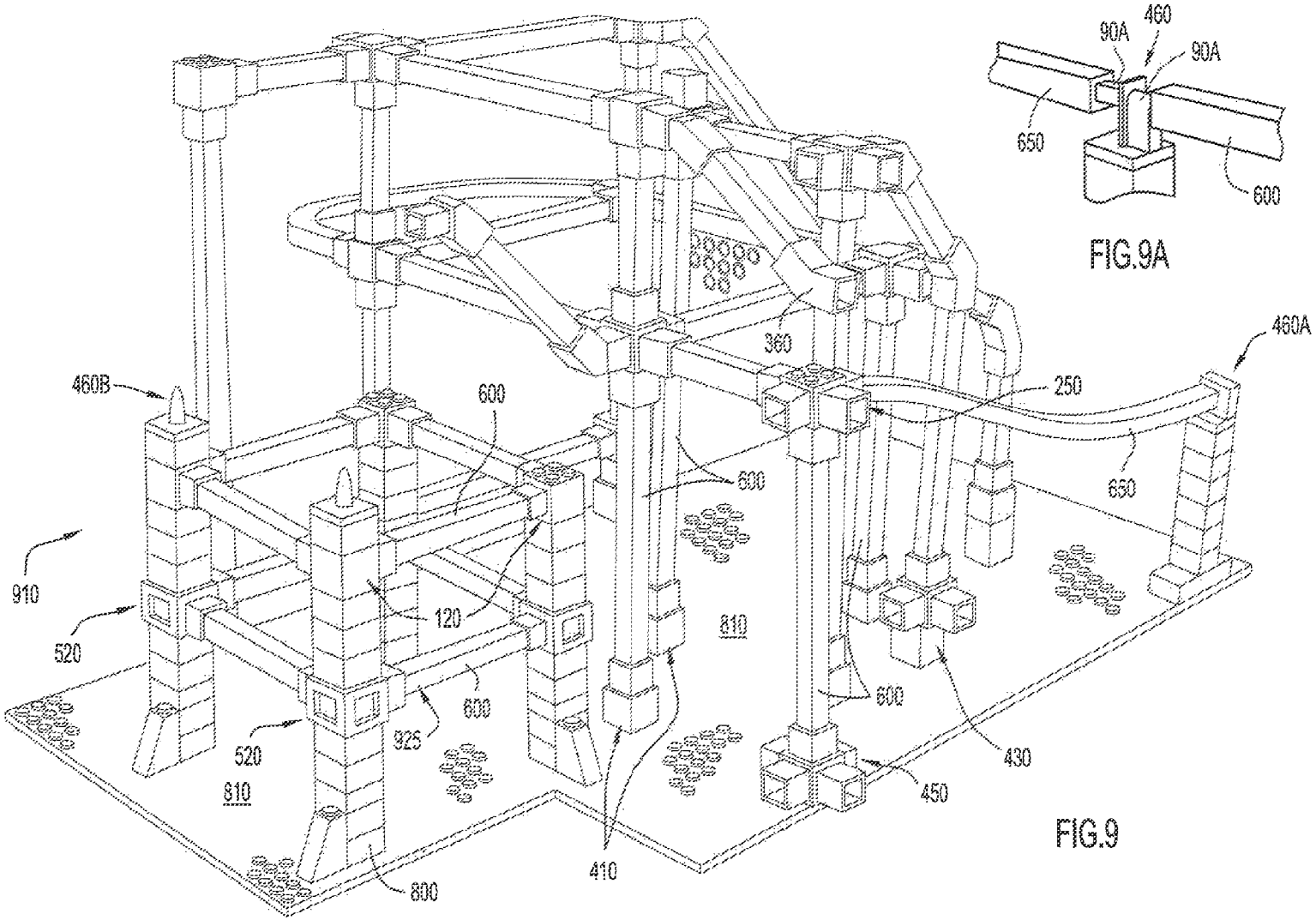

Now turning to FIGS. 8-9, two perspective views of a building assembly 910 are shown in various states of construction. In this embodiment, the building components of the present invention are used to span horizontal, vertical, and diagonal distances above a number of conventional plates 810. Typically, conventional building blocks or building components which include receivers on their bottom surface, such as families 100 and 400, may be used to mount an assembly to a flat plate. However, preferably, connectors from family 400 are first coupled to building surface to provide a connector that is perpendicular to the building surface. In this embodiment, connectors 410, 430 and 450 are coupled to the plate 810 or to conventional building blocks 800 extending from the plate 810 (the receptacles 84 of connector 410 receive the studs included on plate 810) to provide receptacles 90 oriented perpendicularly to plate 810 so that elongate members 600 may be inserted therein and extend away from the plate 810 (vertically in this embodiment).

Then, once the assembly begins to be built upwards with elongate members 600, sliders or slider assemblies—any number of sliders coupled together via an elongate member(s)—may be slid onto the elongate members 600. For example, in FIG. 8, a single slider 530 is shown mounted on an elongate member disposed horizontally towards the top of the assembly while a slider assembly 915 formed by two sliders 510 coupled together via an elongate member 600 is shown mounted on the foremost vertically oriented elongate members 600. Additionally, in FIG. 9, four sliders 520 are shown coupled together by four elongate members 600 to form a slider assembly 925 which is movably mounted on four vertically oriented elongate members 600. After the sliders are inserted onto elongate members 600, another connector, such as those connectors from families 200 and 300 may be inserted onto the free end of the elongate members to contain the slider and/or continue building. In the embodiments shown in FIGS. 8-9, connectors 340 and 350 (as well as other connectors of family 300) are predominantly used so that the user has an opportunity to continue building vertically with building components of the present invention (i.e. connectors and elongate members). If instead, a user wants to use conventional building blocks at a certain height, a user may cap an elongate member 600 with a connector from family 200, each of which includes studs on its top surface. The assembly according to the invention is designed to stay on a grid that has standard distances between studs in all directions.

Still referring to FIGS. 8-9, but now with reference to FIG. 9A as well, the connectors 15 and elongate members may be shaped as desired in various embodiments, as mentioned above. As an example, building assembly 910 also includes connectors with angled receptacles and flexible elongated members, in order to create new and interesting connections. First, in FIG. 8, a slider 550 with an angled receptacle is shown coupled, via an elongate member 600, to a slider 510. Similarly, in FIG. 9, a connector 360 is shown that is substantially similar to connector 310 except that one of the receptacles is angled, preferably at a forty-five degree angle, in comparison to the opposite receptacle included on this connector. In other embodiments, angled receptacles may also be included on any desirable connector and may be angled at any desirable angle. Referring to FIG. 8, a connector 533 is shown coupling the two portions 531A and 531B of component 530 together.

Second, in FIGS. 8, 9, and 9A a flexible elongated member 650 is shown. In FIG. 8, the flexible elongate member 650 is in its rest or biased configuration (i.e. a flat or straight configuration) and in FIG. 9, the flexible elongated member 650 is shown flexed between a first connector (connector 250) and a second connector 460A. Connector 460A, as well as connector 460B, is an embodiment of connector 460 which, as seen in FIG. 9A, is a connector that is similar to those connectors included in family 400, insofar as it includes receiving areas on its bottom surface and a receptacle on its top surface. However, in this particular embodiment, the receptacles included on connector 460 are not receptacles 90 as shown in FIGS. 3-5. Instead, the receptacles included on connector 460 are insertable receptacles 90A and may be coupled to an elongate member (i.e. elongate member 600 or 650) by being inserted into the slot 614 included on the elongate member, as was briefly mentioned above. In some embodiments, the insertable receptacles 90A may be horizontally oriented (connector 460A), but in other embodiments the insertable receptacles may be vertically oriented (connector 460B). Either way, the insertable receptacles 90A may be securely coupled to an elongate member 600 with a slot 614 when desired.

Figure 10:
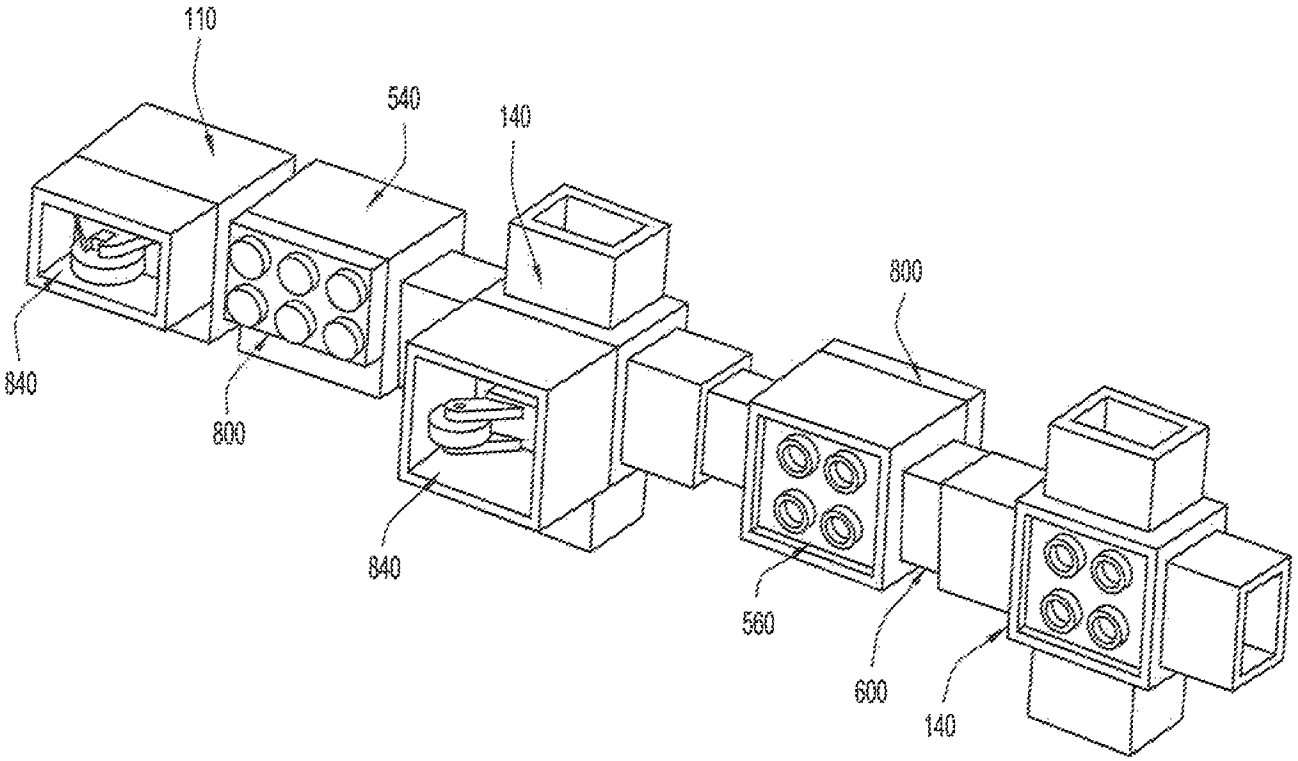
FIG. 10 shows an additional assembly constructed from another exemplary set of building components, in accordance with the present invention.

Finally, turning to FIG. 10, another exemplary embodiment of an assembly of building components of the present invention is shown. Moving from right to left as seen in FIG. 10, the assembly includes two connectors 140 coupled together via an elongate member 600 with a slider 560 mounted thereon. The leftmost connector 140 is then coupled to a connector 110 via an elongate member 600 with a slider 540 mounted thereon. As discussed above, slider 540 includes studs on its top and bottom surfaces. By comparison, slider 560 also includes coupling features on only its top and bottom surfaces, but slider 560 includes receiving areas on its bottom surfaces and studs on its top surface, as opposed to including studs on each. Thus, conventional building blocks may be coupled to slider 560 in a conventional manner either below or above the slider 560 and may be coupled to the bottom surface of slider 540 in an upside-down orientation, as shown via the exemplary blocks 800 coupled to the top and bottom surface of sliders 550 and 540, respectively. Moreover, the assembly of FIG. 10 also includes caster blocks 840 coupled to the lower surfaces of the connectors 110 and 140 which may allow the assembly to roll on a support surface as desired.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims. For example, a building component of the present invention can be of any size and shape.

It is also to be understood that building components of the present invention, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Finally, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

What is claimed:

1. A set of building components comprising:

at least one building component comprising:

a main body;

at least one first receptacle extending away from the main body; and a second receptacle extending through the main body;

an elongate member including a first end and a second end, wherein the first end of the elongate member is configured to be removably secured in one of the at least one first receptacle included on a first building component of the at least one building component and the second end of the elongate member is configured to be removably secured in one of the at least one first receptacle included on a second building component of the at least one building component to couple the first building component to the second component at a distance away from the first building component, and wherein the elongate member is configured to movably engage the second receptacle such that the at least one building component can slide along a length of the elongate member.

2. The set of building components of claim 1, wherein the at least one building component further comprises:

an upper surface; and at least one side wall extending downwards from the upper surface.

3. The set of building components of claim 2, wherein the at least one first receptacle extends perpendicularly outward from one or more of the at least one side wall.

4. The set of building components of claim 2, wherein the main body includes four side walls and one of the at least one first receptacle extends perpendicularly outward from each of the four side walls, wherein the four side walls are substantially rectangular such that each of the first receptacles is offset approximately ninety degrees from the other first receptacles.

5. The set of building components of claim 3, wherein the at least one building component further comprises:

at least one receiving area; and at least one stud, wherein a stud included on a first building component is configured to engage a receiving area included on a second building component, and vice versa, to removably couple the first building component to the second component adjacent each other; and wherein the at least one stud extends upwardly from the upper surface of the main body.

6. The set of building components of claim 5, wherein the at least one stud includes an outer surface defining the periphery of the at least one stud, the at least one receiving area is formed in a cavity that is formed collectively by the main body and side walls of the building component, and the outer surface of the at least one stud is configured to engage the at least one receiving area in the cavity.

7. The set of building components of claim 5, wherein the at least one receptacle comprises:

four receptacle walls which extend perpendicularly from the main body to form a receptacle cavity therebetween.

8. The set of building components of claim 1, wherein the elongate member further comprises:

a top;

a first side and a second side extending downward from the top; and an interior wall that extends arcuately upwardly towards the top between the first side and the second side to form a longitudinal slot along at least a portion of the elongate member.

9. The set of building components of claim 1, wherein the elongate member is substantially C-shaped.

10. A set of building components comprising:

a first building component;

a second building component, wherein the first and second building components each include at least one receptacle;

an elongate member including a first end, a second end, and a slot extending along a portion of the elongate member between the first end and the second end, wherein the elongate member is substantially C-shaped, and wherein the first end of the elongate member is configured to be removably secured in a receptacle of the first building component and the second end of the elongate member is configured to be removably secured in a receptacle of the building component to couple the first building component to the second component at a distance away from the first building component; and a plate, the plate being configured to engage the slot of the elongate member to movably couple the plate to the elongate member.

11. The set of building components of claim 10, wherein the elongate member further comprises:

a first side;

a second side and a third side extending downward from the first; and an interior wall that extends arcuately upwardly towards the first side between the second and third sides to form a longitudinal slot along at least a portion of the elongate member.

12. The set of building components of claim 10, wherein the slot is substantially keyhole-shaped.

13. The set of building components of claim 11, wherein the second and third walls of the elongate member are resilient, such that that the second and third walls may be selectively flexed into the slot to allow the elongate member to be inserted into a receptacle and configured to naturally return to their original position to secure the elongate member to the receptacle once inserted therein.

14. The set of building components of claim 10, wherein the first and second building component each further comprise:

at least one receiving area; and at least one stud, wherein the at least one stud of the first building component is configured to engage the at least one receiving area of the second building component, and vice versa, to removably couple the first building component to the second component adjacent each other.

15. A building component for a set of building components, comprising:

a main body with an upper surface; and at least one side wall extending downwards from the upper surface;

at least one grid of studs extending from at least one of the upper surface and the at least one side wall; and at least one receptacle formed on at least one of the upper surface or side walls that do not include a grid of studs, each of the at least one receptacles including receptacle walls configured to collectively form a receptacle cavity configured to movably engage the perimeter of a c-shaped elongate member, such that the at least one building component can slide along a length of the elongate member.

16. The building component of claim 15, wherein the at least one receptacle extends through the main body.

17. The building component of claim 15, wherein the receptacle is movably coupled to the main body via a rotatable support, such that the main body is configured to rotate around the receptacle.

18. A set of building components comprising:

at least one building component of claim 15;

at least one elongate member including a longitudinal slot and configured to engage the at least one receptacle in order to couple a first building component of claim 16 to a second building component of claim 16 at a distance apart; and a plate configured to be coupled to the at least one elongate member via the longitudinal slot.

* * * * *